US005292016A

United States Patent [19]

Casavant et al.

[11] Patent Number: 5,292,016

[45] Date of Patent: Mar. 8, 1994

[54] LUFFING JIB BACKSTOP ASSEMBLY

[75] Inventors: Terry Casavant; Michael Wanek, both of Two Rivers, Wis.

[73] Assignee: The Manitowoc Company, Manitowoc, Wis.

[21] Appl. No.: 958,230

[22] Filed: Oct. 8, 1992

[51] Int. Cl.[5] ..... B66C 23/00

[52] U.S. Cl. ..... 212/177; 212/188; 212/262

[58] Field of Search ..... 212/175, 176, 177, 182, 212/186, 187, 188, 222, 255, 232

[56] References Cited

U.S. PATENT DOCUMENTS

| | | | |
|---|---|---|---|
| 2,382,767 | 8/1945 | Zeilman | 212/187 |
| 3,426,915 | 2/1969 | Tesch | 212/188 |
| 3,804,264 | 4/1974 | Hedeen et al. | 212/222 |
| 4,109,681 | 8/1978 | Stahl | 212/255 |
| 4,394,914 | 7/1983 | Privat | 212/222 |
| 4,412,622 | 11/1983 | Gyomerey . | |

FOREIGN PATENT DOCUMENTS 211587 3/1967 Sweden .

OTHER PUBLICATIONS

Grove HL150 Operator's Manual, p. 2-2-40.
Link Belt HC268 Operator's Manual, p. 8-1.
"Manitowoc 4100W Tower Crane," 1976, pp. 1-3.

*Primary Examiner*—David M. Mitchell
*Assistant Examiner*—Stephen P. Avila
*Attorney, Agent, or Firm*—Willian Brinks Hofer Gilson & Lione

[57] ABSTRACT

A luffing jib backstop assembly for limiting rotation between a luffing jib and a boom to which the luffing jib is attached is disclosed. The assembly comprises at least one backstop pendant attached at a first end to the luffing jib and at a second end to the boom, the pendant having a length sufficient to allow the luffing jib to be extended to an angle of 180° with respect to the boom. The assembly further comprises a deployable member which engages the backstop pendant and which, upon full deployment, holds a portion of the backstop pendant away from the boom and luffing jib such that the pendant and deployable member prevent the luffing jib from rotating with respect to the boom beyond a permissible operating angle.

19 Claims, 3 Drawing Sheets

LUFFING JIB BACKSTOP ASSEMBLY

BACKGROUND OF THE INVENTION

The present invention relates to lift cranes, and more particularly to a luffing jib backstop arrangement for lift cranes.

Lift cranes include a boom attached to the crane bed upper works, and many times include a luffing jib pivotally attached to the top of the boom. In a tower crane configuration, the boom of the crane extends essentially vertically from the crane bed. The top end of the luffing jib may be raised and lowered, thus changing the angle of the luffing jib with respect to the boom. This is accomplished by the crane operator using winches and cables, controlled from the crane cab. Loads are suspended from a cable carried by a sheave at the top end or head of the luffing jib. The load may be positioned by raising and lowering the luffing jib and/or (except for tower cranes) the boom, retracting or letting out a length of cable, or a combination of the foregoing.

Cranes with luffing jibs generally incorporate backstop pendants to limit the operating angle of the luffing jib with respect to the boom. This is a safety precaution because the boom and luffing jib are constructed and rigged to operate only where the luffing jib extends from the boom at an angle less than 180°. By limiting the operating angle of the luffing jib, the backstop pendants prevent the luffing jib from going over backwards upon the sudden release of the load, upon a wind gust, or when the jib/strut/pendant system center of gravity is to the rear of the hinge point and overtakes the jib dead weight (unloaded jib). The backstop pendants are generally attached at one end to the boom in the area of the boom head and at the other end of the pendant to the luffing jib in the area of the butt end of the luffing jib. Because the pendants are of a fixed length, the pendants prevent the luffing jib from rotating with respect to the boom beyond the safe operating angle, which is less than 180° for all cranes.

The present invention is directed to the problem associated with attaching the backstop pendants to the crane prior to operational deployment of the crane. For instance, because the pendants are of a fixed length and are generally attached in the areas of the boom head and luffing jib butt, the luffing jib must be rotated with respect to the boom to an angle within the desired operational limits of the crane before the pendants can be attached. Since the boom and the luffing jib are usually laid out along the ground during assembly and prior to deployment, this rotation must be accomplished by elevating the boom head and luffing jib butt. The boom head and luffing jib butt, and thus the pendant attachment points, are then a significant distance above the ground. A worker then has to be positioned far above the ground in order to attach the pendants, usually by means of a very tall ladder or a man-lift, with the attendant logistical and safety concerns.

One former approach to solving this problem involved attaching the pendants to the luffing jib head or the boom butt. Ground level access to the attachment points was thus permitted even though the boom head and luffing jib butt were raised in the air. However, according to this particular solution, the pendants must span nearly the length of the luffing jib or boom. Because of their length, the pendants add significantly to the weight of the crane structure. This additional weight results in reduced lift capacity. Also, multiple pendants of different lengths are then required if the length of the boom or luffing jib on the crane is changed.

SUMMARY OF THE INVENTION

A luffing jib backstop assembly for limiting rotation between a luffing jib and a boom to which the luffing jib is attached has been invented. The assembly comprises at least one backstop pendant attached at a first end to the luffing jib and at a second end to the boom, the pendant having a length sufficient to allow the luffing jib to be extended to an angle of 180° with respect to the boom. The assembly further comprises a deployable member which engages the backstop pendant and which, upon full deployment, holds a portion of the backstop pendant away from the boom and luffing jib such that the pendant and deployable member prevent the luffing jib from rotating with respect to the boom beyond a permissible operating angle.

The deployable member preferably comprises two telescopic struts which are attached at a first end of the telescopic struts to the boom adjacent the point at which the luffing jib and the boom pivot with respect to one another. A first pair of wire ropes are attached between the second end of the telescopic struts and the boom. A second pair of wire ropes is attached between the second end of the telescopic struts and the luffing jib. One of each pair of the wire ropes then act in concert as a backstop pendant. Upon full extension of the telescopic struts, slack in the backstop pendants is drawn up, and the effective length of the backstop pendants is reduced. Latches are provided which fix the length of the telescopic struts in their extended position.

The invention permits the ground level attachment of the pendants prior to the operational deployment of the crane. Because the telescopic struts draw up the slack in the pendants after the pendants are fully attached, the pendants may be attached when the luffing jib and the boom are at an angle with respect to one another that is beyond the desired operational limits of the crane. The invention also permits the use of a single set of backstop pendants for cranes of varying geometries; that is, cranes having differing luffing jib lengths, boom lengths, or any combination thereof.

In the preferred embodiment, the invention further includes a mechanism for disengaging the latches used to fix the length of the telescopic struts in their extended position. The mechanism provides for the remote disengagement of the latches, permitting the latches to be disengaged while the boom top and luffing jib butt are still in the air. The entire boom and luffing jib assembly is then lowered to the ground.

These and other advantages of the present invention, as well as the preferred embodiment thereof, will best be understood in view of the appended drawings, a brief description of which follows.

DETAILED DESCRIPTION OF THE DRAWINGS AND PREFERRED EMBODIMENTS OF THE INVENTION

Figure 1:
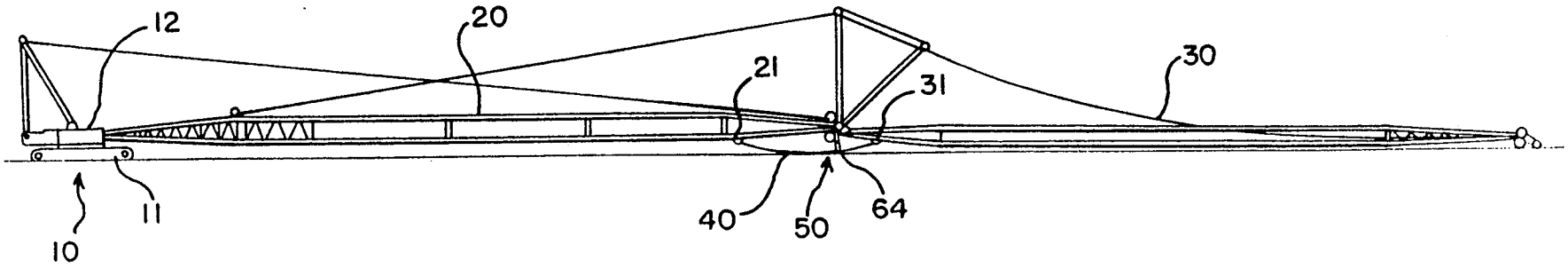
FIG. 1 is a side view of a crane of the preferred embodiment of the present invention, with the boom and luffing jib laid out along the ground.

FIG. 1 shows a crane 10 positioned prior to operational deployment. This crane generally comprises lower works 11, upper works 12, and a boom 20 to which is pivotally attached a luffing jib 30. The boom 20 and luffing jib 30 are laid out essentially parallel to one another along the ground. This positioning of the boom 20 and luffing jib 30 facilitates the ready attachment of the backstop pendants 40 at ground level. The backstop pendants 40 (only one of which is shown in the side view) are attached at either side of the crane boom 20 and luffing jib 30.

The crane is further comprised by a luffing jib backstop assembly comprising a deployable member 50 to which the backstop pendants 40 attach. In the preferred embodiment, the luffing jib backstop assembly actually utilizes a pair of telescopic struts 60, as shown in FIG. 4, though only one of the struts 60 can be seen in the side views of FIGS. 1-3.

Figure 3:
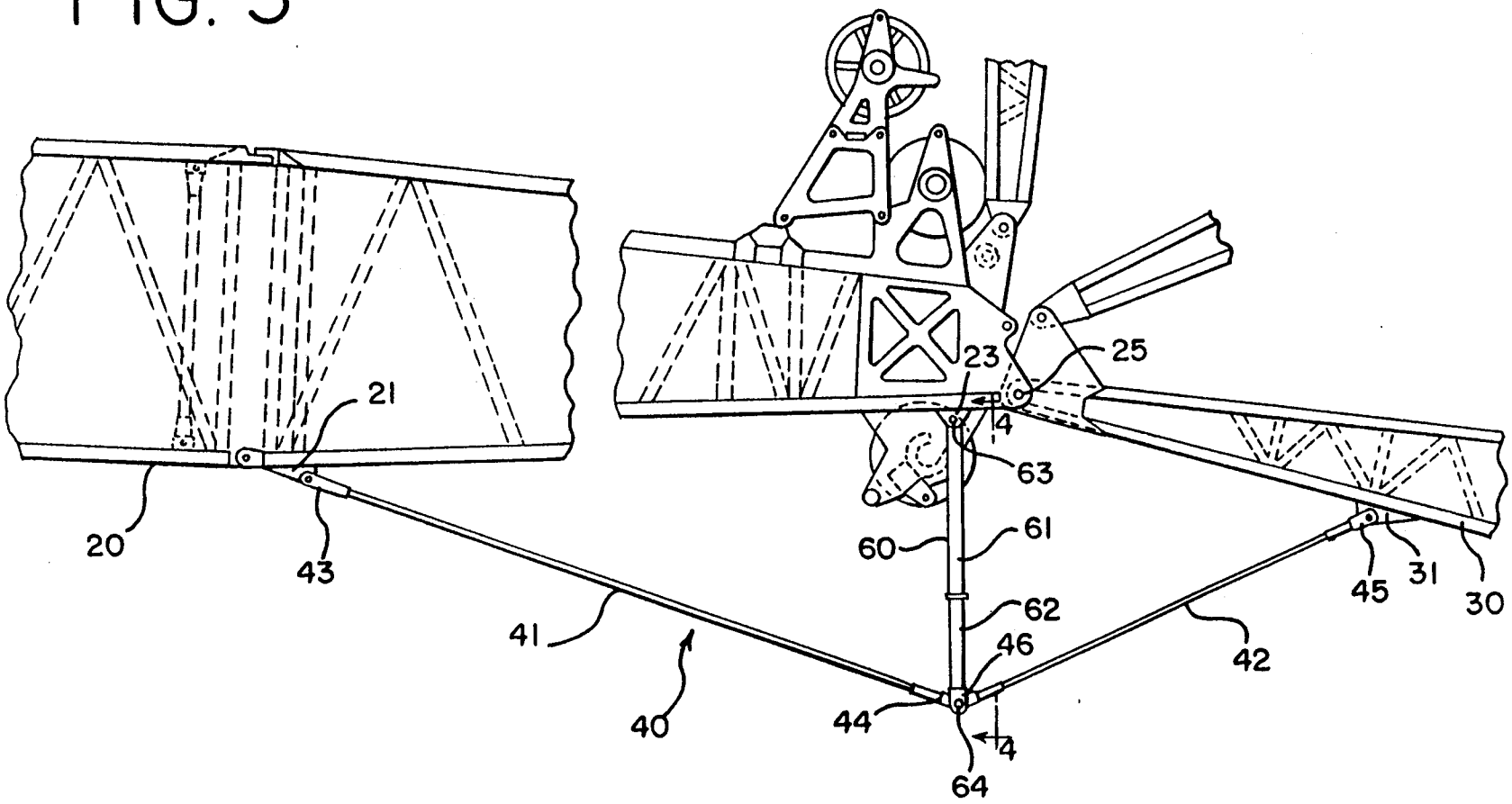
FIG. 3 is an enlarged side view of the region of the crane of FIG. 1 where the boom and the luffing jib are pivotally attached.
Figure 4:
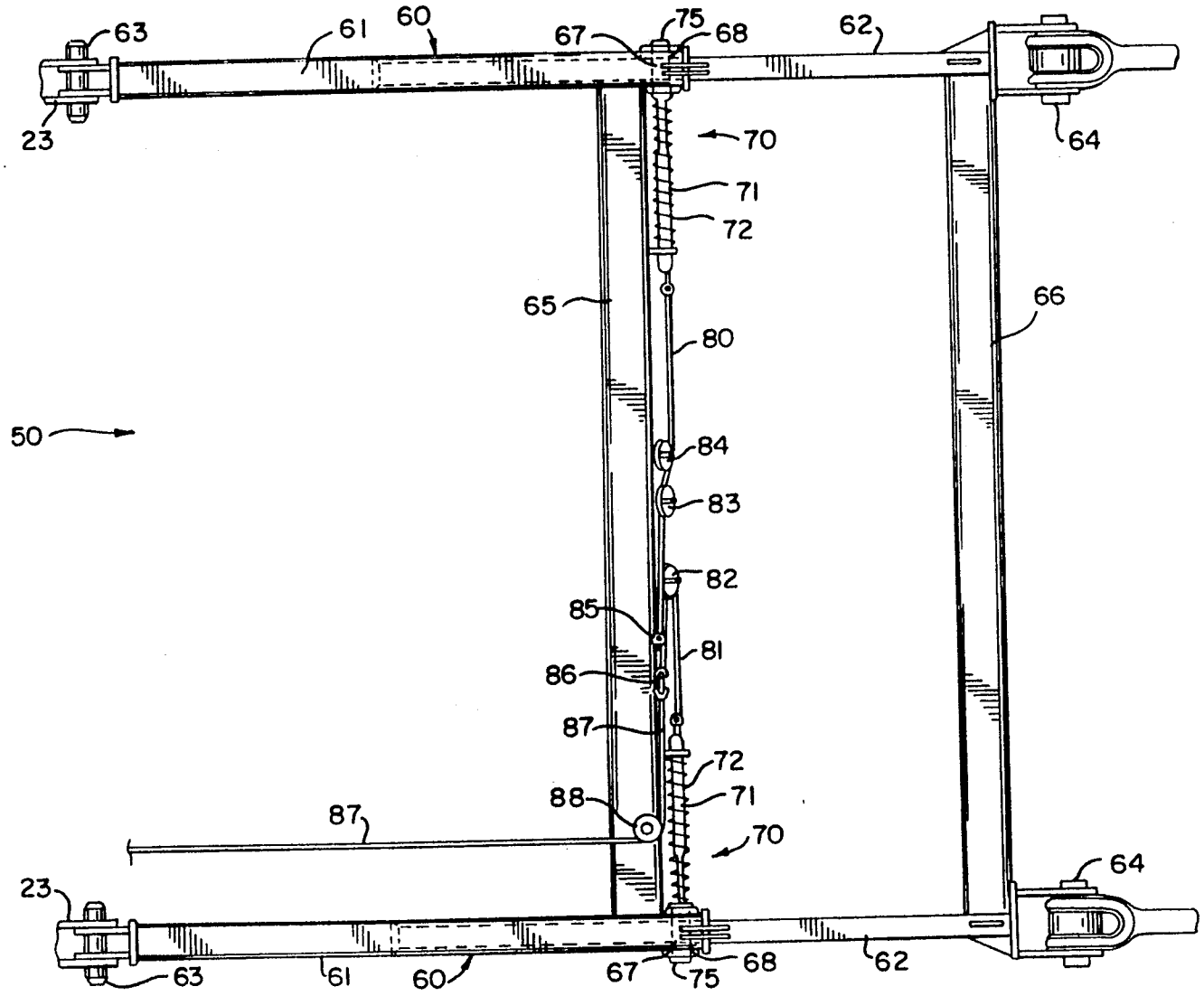
FIG. 4 is an elevational view of the telescopic strut assembly taken along lines 4—4 of FIG. 3.

As shown in FIG. 3, a first end 63 of the telescopic strut 60 of the preferred embodiment is pivotally attached to the boom 20 at point 23 adjacent the point 25 at which the luffing jib 30 and the boom 20 pivot with respect to one another. The telescopic strut 60 of the preferred embodiment comprises a strut outer tube 61 and a strut inner tube 62. The strut inner tube 62 slides freely within the strut outer tube 61.

As shown in FIG. 3, the strut inner tube 62 extends outwardly from within the strut outer tube 61. Prior to this state of deployment, the strut inner tube 62 is almost wholly positioned within the strut outer tube 61 of the telescopic strut 60, as shown in FIG. 1. Deployment of the strut inner tube 62 effectively lengthens the telescopic strut 60.

Each backstop pendant 40 preferably comprises two pieces of wire rope 41 and 42. Alternatively, each pendant may comprise tension bars or other tension members. Wire rope 41 is attached at first end 43 at point 21 to the boom 20 in the general area of the boom head and at second end 44 to the second end 64 of the telescopic strut 60. Wire rope 42 is attached at second end 45 to the luffing jib 30 at point 31 in the general area of the luffing jib butt and at first end 46 to the second end 64 of the telescopic strut 60.

Figure 2:
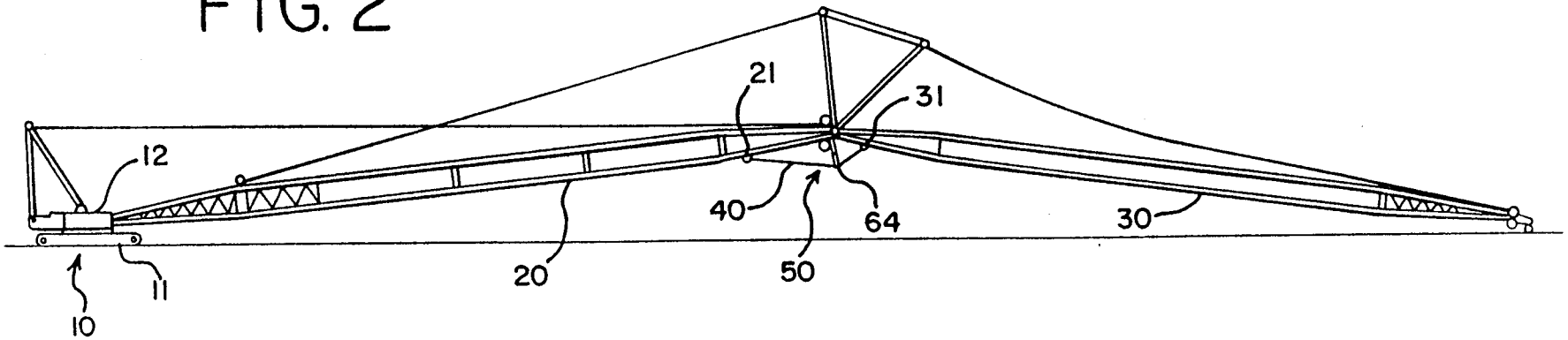
FIG. 2 is a side view of the crane of FIG. 1 with the boom elevated.

In the pre-deployment position shown in FIG. 1, slack is present in the backstop pendants 40. This slack is visualized in FIG. 1 as an arc in the backstop pendants 40. This slack facilitates attachment of the pendants 40 to the crane at points 21 and 31 on the boom 20 and luffing jib 30, respectively, and to the second end 64 of the telescopic strut 60. Attachment is possible because the telescopic strut 60 is in its retracted rather than extended position As shown in FIGS. 1 and 2, the length of the backstop pendants 40 relative to the length of either the boom 20 or luffing jib 30 is small. It is also evident that the lengths of the pendants 40 are independent of the lengths of the boom 20 or luffing jib 30. Thus, a single set of backstop pendants 40 may be utilized for any boom and luffing jib combination.

FIG. 2 shows the crane of FIG. 1 after the first step of operational deployment. The boom 20 has been raised and the luffing jib 30 permitted to pivot with respect to the boom 20. (The luffing jib 30 may incorporate a multiposition jib erection support member as disclosed in U.S. patent application Ser. No. 07/833,772, incorporated herein by reference.) At this particular position, the deployable member 50 is fully deployed, that is, the second end 64 of strut 60 is at its maximum distance from the boom 20.

In the preferred embodiment, upon raising the boom 20 and pivoting the luffing jib 30 with respect to the boom 20, the weight of the backstop pendants 40 and strut inner tube 62 draws out the telescopic strut 60 to its fully extended position. As the telescopic strut 60 extends, it takes up the slack in the backstop pendants 40, drawing taut each of the wire ropes 41 and 42. The fully extended telescopic strut 60, in cooperation with the backstop pendants 40, prevents the absolute distance between the attachment points 21 and 31 of the backstop pendants from exceeding a prescribed distance. This distance corresponds to the prescribed maximum operational angle of the boom 20 and luffing jib 30 with respect to one another.

FIG. 3 shows the position of the boom 20 and the luffing jib 30 relative to one another where no slack is present in the pendants 40. The boom 20 and luffing jib 30 are positioned at their maximum operational angle with respect to one another. This situation may occur, not only during crane set up as shown in FIG. 2, but also during crane operation, including a tower crane configuration wherein the boom 20 has been raised and fixed in a position essentially perpendicular to the ground.

FIG. 4 shows in detail the telescopic struts 60 of the deployable member 50 in the luffing jib backstop assembly of the preferred embodiment. The preferred deployable member 50 comprises two telescopic struts 60 operating in unison and connected by a pair of cross members 65 and 66. The deployable member 50 is pivotally attached at first end 63 of each strut outer tube 61 to the boom 20 at connection point 23. Both the strut outer tubes 61 and the strut inner tubes 62, respectively, include openings 67 and 68 dimensioned to receive a pin 71, forming part of a latch or retractable member 70. When the openings 67 of the strut outer tubes 61 and the openings 68 of the strut inner tubes 62 are aligned, the pin 71 may pass through the aligned openings 67 and 68 and between both outer 61 and inner tubes 62 so as to restrain the movement of the outer 61 and inner tubes 62 relative to one another. Thus, the pins 71 prevent retraction of the telescopic strut 60 under a compression load. Shear stops 69 prevent overextension of the strut inner tubes 62.

The latch or retractable member 70 of the preferred embodiment comprises a spring-loaded pin 71 which automatically engages upon extension of the telescopic strut 60. Each pin 71 is surrounded and engaged by a spring 72. Alternatively, the retractable member 70 may be pneumatically or electrically actuated.

In the preferred embodiment, when the aligned openings 67 and 68 present themselves to the pins 71, the pins 71 are pressed into the aligned openings 67 and 68 by the springs 72. The arrangement is such that actuation of the pins 71 will produce an audible snap loud enough to apprise the cab operator and those on the ground that the pins 71 have been engaged. The telescopic struts 60 are thus fixed in their extended position, and the luffing jib backstop assembly permits safe operation of the crane. It is also preferred that end 75 of each pin 71 extend through the strut outer tube 61 and inner tube 62 so as to be visible from the ground. Those on the ground will thus be able to visibly, as well as audibly, ensure that the pins 71 have been engaged and that the crane 10 is safe for operation.

The preferred embodiment further comprises a latch disengagement mechanism comprising a remote winch (not shown) and control cable system which permits the remote disengagement of the latches to permit collapse of the telescopic struts 60 as the boom 20 and luffing jib 30 are brought close to the ground during disassembly.

An end of each of control cables 80 and 81 is attached to an end of each of the retractable members 70. Each of these control cables 80 and 81 passes around a sheave 82 or series of sheaves 83 and 84, each sheave being bracketed to the cross member 65, until the control cables 80 and 81 may be joined together by means of a wire rope clip 85. The united cables are then attached by means of a shackle 86 to a third cable 87 which passes around another sheave 88, itself bracketed to the cross member 65, en route to the crane upper works 12. This cable 87 runs the length of the boom 20 to where it is wound on a spool of a winch (not shown) mounted on the boom butt. The winch may be either a manual, hand-operated winch or a powered winch. Activation of the winch draws up the cable and withdraws the pins 71. Even though this cable 87 runs the length of the boom 20, it is of a small diameter and thus does not add much weight Also, if the boom 20 that is used is shorter than the maximum length of the cable 87, the excess cable 87 is simply stored on the winch.

One alternative embodiment of the invention utilizes backstop pendants each comprised by a single wire rope. According to this embodiment, the deployable member engages a central portion of the pendant. When the deployable member is fully deployed, it holds the central portion of the backstop pendant a distance from the boom and luffing jib. The effective length of the backstop pendant is thus reduced.

Another embodiment of the invention utilizes a single strut as the deployable member rather than a pair of struts as described in the preferred embodiment, above. According to this alternative embodiment, the invention also uses a single backstop pendant rather than a pair of backstop pendants.

It must be appreciated that the apparatus of the present invention is capable of being incorporated in the form of a variety of embodiments, only some of which has been fully illustrated and described above. The invention may be embodied in other forms without departing from its spirit or essential characteristics. The described embodiment is to be considered in all respects only as illustrative and not restrictive and the scope of the invention is, therefore, described by the appended claims rather than by the foregoing description. All changes which come within the meaning and range of equivalency of the claims are to be embraced within their scope.

We claim:

1. A luffing jib backstop assembly for limiting rotation between a luffing jib and a boom to which the luffing jib is attached, the assembly comprising:

(a) at least one backstop pendant attached at a first end to the luffing jib and at a second end to the boom, the pendant having a length sufficient to allow the luffing jib to be extended to an angle of 180° with respect to the boom;

(b) a deployable member which engages the attached backstop pendant and which, prior to deployment, permits the luffing jib to be extended to an angle of 180° with respect to the boom and which, upon full deployment, holds a portion of the attache backstop pendant away from the boom and luffing jib such that the pendant and deployable member prevent the luffing jib from rotating with respect to the boom beyond a permissible operating angle which is less than 180°.

2. The luffing jib backstop assembly of claim 1 wherein the deployable member comprises a telescopic strut.

3. The luffing jib backstop assembly of claim 1 further comprising a retractable member for selectively fixing the deployable member in its fully deployed position.

4. The luffing jib backstop assembly of claim 1 wherein the at least one pendant comprises two separate pieces of wire rope, with one end of each piece of wire rope constituting said first and second pendant ends and the other end of each piece of wire rope secured to the deployable member.

5. The luffing jib backstop assembly of claim 2 further comprising a latch for selectively fixing the telescopic strut in its fully deployed position.

6. The luffing jib backstop assembly of claim 1 wherein the deployable member is attached to the boom.

7. The luffing jib backstop assembly of claim 1 wherein the at least one pendant comprises two pendants.

8. A luffing jib backstop assembly for limiting rotation between a crane luffing jib with respect to a crane boom, the assembly comprising:

(a) at least one backstop pendant, comprising two wire ropes, a first end of a first wire rope attached to the boom and a second end of the second wire rope attached to the luffing jib;

(b) a telescopic strut which is attached at a first end to the crane adjacent the point at which the luffing jib and the boom pivot with respect to one another and to which is attached at a second end of the strut a second end of the first wire rope and a first end of the second wire rope; and (c) a latch for fixing the telescopic strut in an extended position.

9. The luffing jib backstop assembly of claim 8 wherein the latch is self-actuating upon extension of the telescopic strut.

10. The luffing jib backstop assembly of claim 8 wherein the latch comprises a spring loaded pin which engages upon extension of the telescopic strut.

11. The luffing jib backstop assembly of claim 8 further comprising a cable which is attached to the latch such that withdrawal of the cable disengages the latch.

12. The luffing jib backstop assembly of claim 11 further comprising a winch connected to the cable.

13. A crane comprising:

a) a boom;

b) a luffing jib pivotally attached to the boom;

c) a pair of backstop pendants each comprising a first and second wire rope, a first end of each first wire rope attached to the boom and a second end of each second wire rope attached to the luffing jib;

d) a deployable member which is attached at a first end to the crane adjacent the point at which the luffing jib and the boom pivot with respect to one another and to which is attached at a second end of the member a second end of each first wire rope and first end of each second wire rope; and e) a retractable member for fixing the deployable member in an extended position;

whereby as the boom is raised and the luffing jib pivoted with respect to the boom, the deployable member extends outwardly from the boom and is fixed in an extended position to effectively limit the operating angle of the luffing jib with respect to the boom.

14. The crane of claim 13 wherein the deployable member comprises two telescopic struts with at least one cross member between the struts, the struts having outer ends comprising the second end of the deployable member attached to the wire ropes.

15. The crane of claim 13 wherein the retractable member comprises a spring loaded pin.

16. The crane of claim 13 further comprising a cable which is attached to the retractable member such that pulling the cable withdraws the retractable member.

17. The crane of claim 16 further comprising a winch for pulling the cable.

18. The crane of claim 13 wherein the deployable member is attached to the boom.

19. The crane of claim 14 wherein the cross member supports sheaves for guiding a cable attached to the retractable member such that pulling the cable withdraws the retractable member.

* * * * *

UNITED STATES PATENT AND TRADEMARK OFFICE

CERTIFICATE OF CORRECTION

PATENT NO. : 5,292,016

DATED : March 8, 1994

INVENTOR(S) : Terry Casavant et al.

It is certified that error appears in the above-indentified patent and that said Letters Patent is hereby corrected as shown below:

In column 5, line 28 after "weight" insert --.--.

Column 6:

In claim 1, line 13, delete "attache" and insert --attached--.

Signed and Sealed this

Twentieth Day of September, 1994

*Attest:*

*Attesting Officer*

BRUCE LEHMAN

*Commissioner of Patents and Trademarks*